US006257874B1

(12) United States Patent
Lin

(10) Patent No.: US 6,257,874 B1
(45) Date of Patent: Jul. 10, 2001

(54) FLAME ADJUSTING DEVICE FOR A GAS BURNING DEVICE

(76) Inventor: Arlo H. T. Lin, No. 5, Lane 25, Da-Tong Rd., Wu-Feng Hsiang, Taichung Hsien (TW)

( * ) Notice: Subject to any disclaimer, the term of this patent is extended or adjusted under 35 U.S.C. 154(b) by 0 days.

(21) Appl. No.: 09/625,208

(22) Filed: Jul. 24, 2000

(51) Int. Cl.[7] ..... F23D 14/28

(52) U.S. Cl. ..... 431/344; 431/153; 251/81; 251/121

(58) Field of Search ..... 431/344, 345, 431/153, 255, 277, 130, 131; 251/81, 121, 291

(56) References Cited

U.S. PATENT DOCUMENTS 3,922,139 * 11/1975 Sugawa ..... 431/344
3,966,392 * 6/1976 Lockwood ..... 431/344
5,564,918 * 10/1996 Lin ..... 431/344

FOREIGN PATENT DOCUMENTS

1285782 * 12/1968 (DE) ..... 431/344
2390678 * 1/1979 (FR) ..... 431/344

* cited by examiner

*Primary Examiner*—James C. Yeung
(74) *Attorney, Agent, or Firm*—Charles E. Baxley, Esq.

(57) ABSTRACT

A flame adjusting device for a gas burning device includes a flame adjusting wheel securely mounted to a disk of a valve on a gas tank and a neck extends from a side of the flame adjusting wheel and a ring is mounted to the neck. A protrusion extends from the ring and is accessible for the users. When shifting the protrusion, the ring and the flame adjusting wheel rotate to adjust the gas released via the valve. When a user wants to change the volume of gas released via the valve, he/she holds the protrusion and rotates the flame adjusting wheel so that the disk of the valve is rotated while the ring is remained still.

4 Claims, 7 Drawing Sheets

FLAME ADJUSTING DEVICE FOR A GAS BURNING DEVICE

FIELD OF THE INVENTION

The present invention relates to a flame adjusting device for a gas burning device and includes a wheel having a neck to which a ring is engaged. A valve extends through the ring and is securely connected to the wheel. The wheel can be rotated to rotate the valve while the neck is hold.

BACKGROUND OF THE INVENTION

A conventional lighter is shown in FIG. 1 and generally includes a valve connected to a top of a tank for receiving butane (for example) therein and the valve includes a disk 12 with a tube 120 extending from the disk 12. A flame adjusting wheel 11 has a threaded inner periphery is mounted to a threaded outer periphery of the disk 12. A gas lever 10 is connected to the tube 120 on the disk 12 so that when lifting the gas lever 10, the valve is actuated and the gas in the tank releases to be burned. A U-shaped member 13 is mounted to the top of the tank and a notch 130 is defined in a lower edge of the U-shaped member 13. A protrusion 111 extends from the adjusting wheel 11 and is accessed from notch 130 so that when shifting the protrusion 111, the disk 12 is rotated to adjust the volume of the gas releasing from the valve. The protrusion 111 can only be shifted within the notch 130 so that if the user wants to adjust the flame to an extreme condition, he/she has to remove the adjusting wheel 11 from the disk 12 and then rotate the disk to change the basic status of the disk 12 so as to have a larger or smaller gas volume that is normally released. Nevertheless, this is not an expected way for the users to adjust the gas volume and could damage the lighter.

The present invention intends to provide a flame adjusting device that allows the user to adjust the status of the valve without disassembling the lighter.

SUMMARY OF THE INVENTION

In accordance with one aspect of the present invention, there is provided a flame adjusting device for a gas burning device which has a valve connected to a gas tank and having a disk which controls a volume of gas released via the valve. A tube extends from the disk and a gas lever is connected to the tube. A striker member is located beside the disk. The flame adjusting device comprises a flame adjusting wheel which has a hole for securely engaging the disk therein. A neck extends from a periphery of the hole and a ring is mounted to the neck. A protrusion extends form the ring so that a user may shift the protrusion to adjust the disk.

The primary object of the present invention is to provide a flame adjusting device for a gas burning device wherein the original status of the disk of the valve of the burning device can be adjusted without disassembling the burning device.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
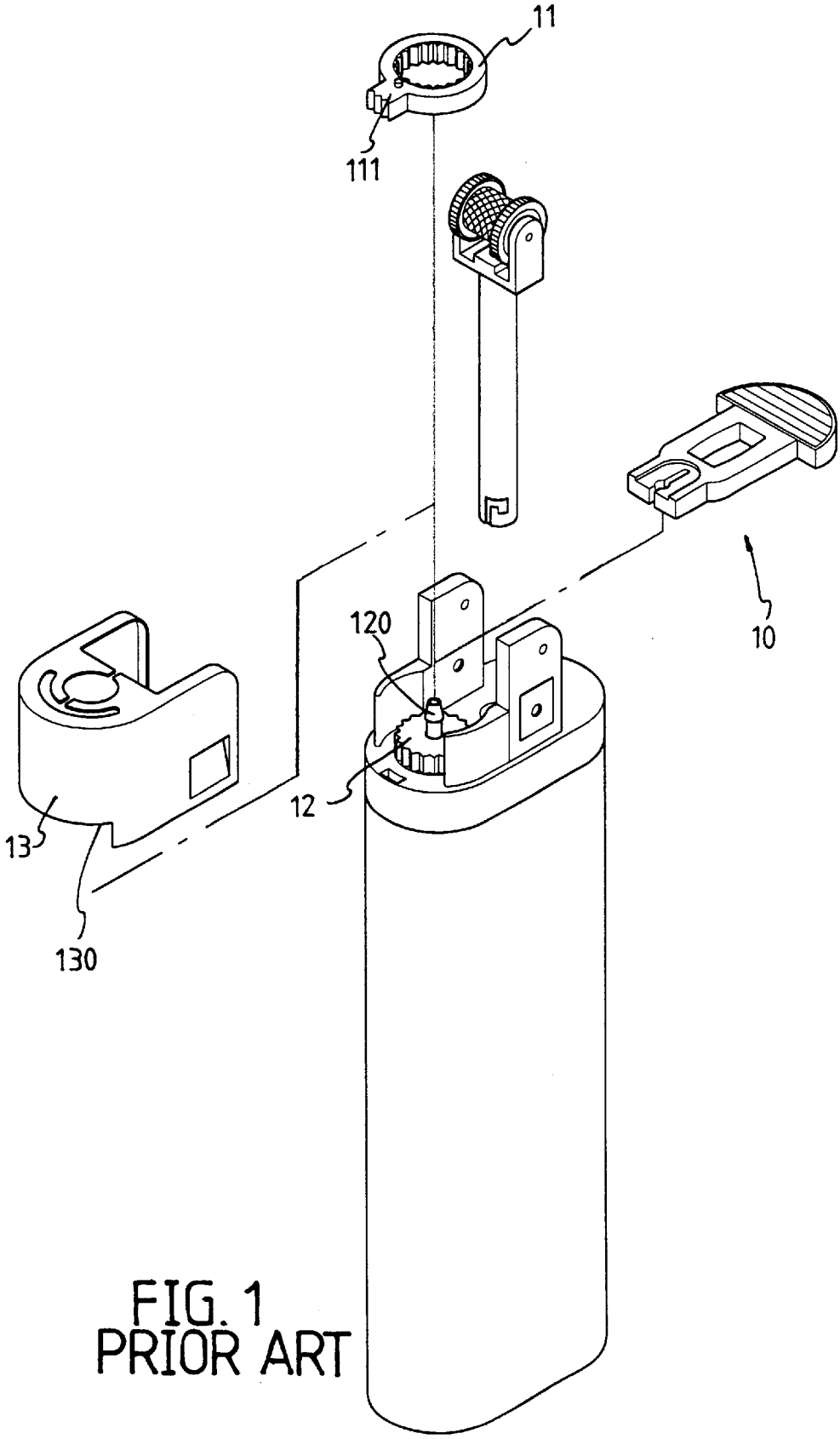
FIG. 1 PRIOR ART
FIG. 1 is an exploded view to show a conventional flame adjusting device for a lighter.
Figure 2:
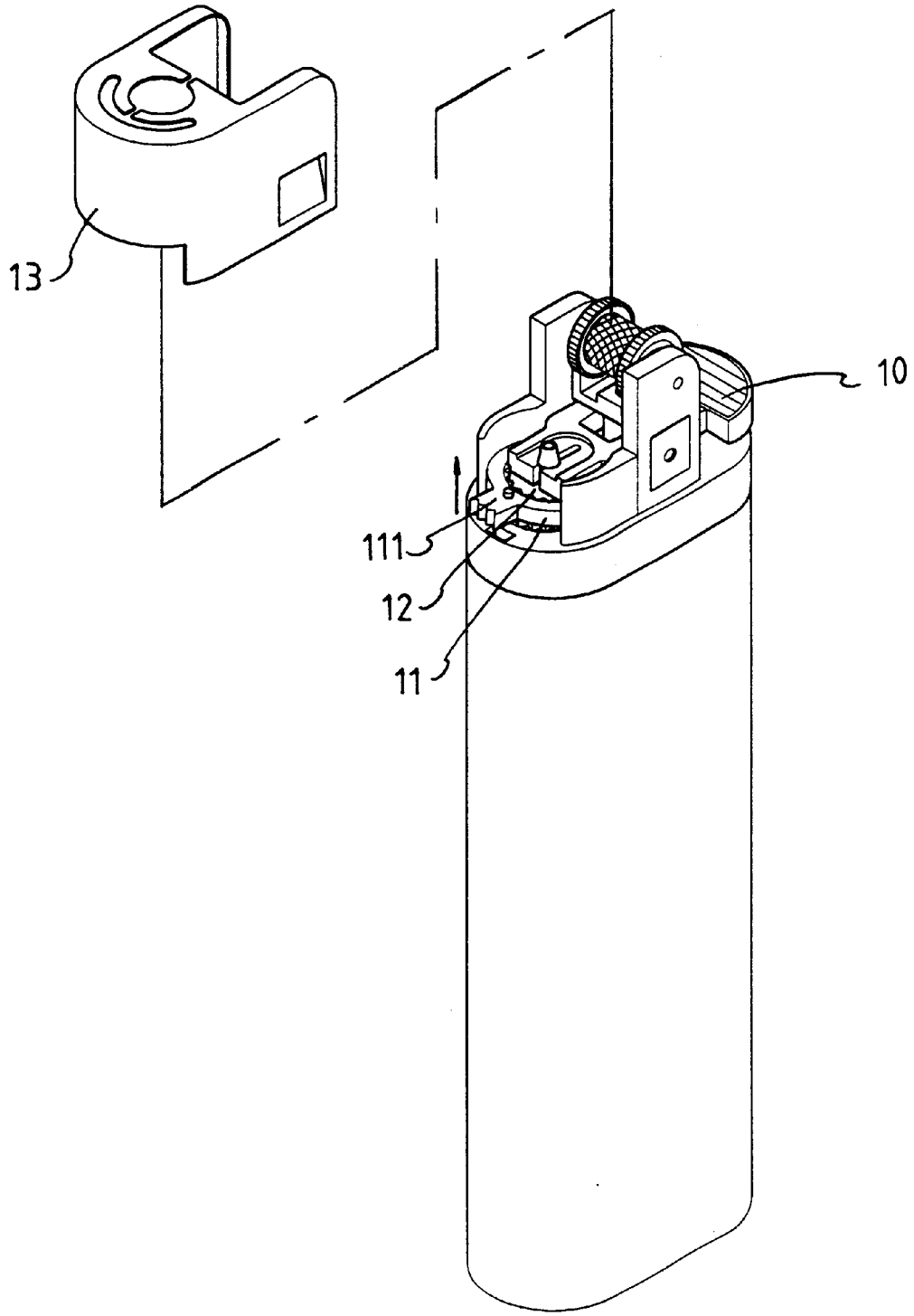
FIG. 2 PRIOR ART
FIG. 2 shows that the flame adjusting wheel is lifted to allow the user to adjust the disk of the lighter as shown in FIG. 1.
Figure 3:
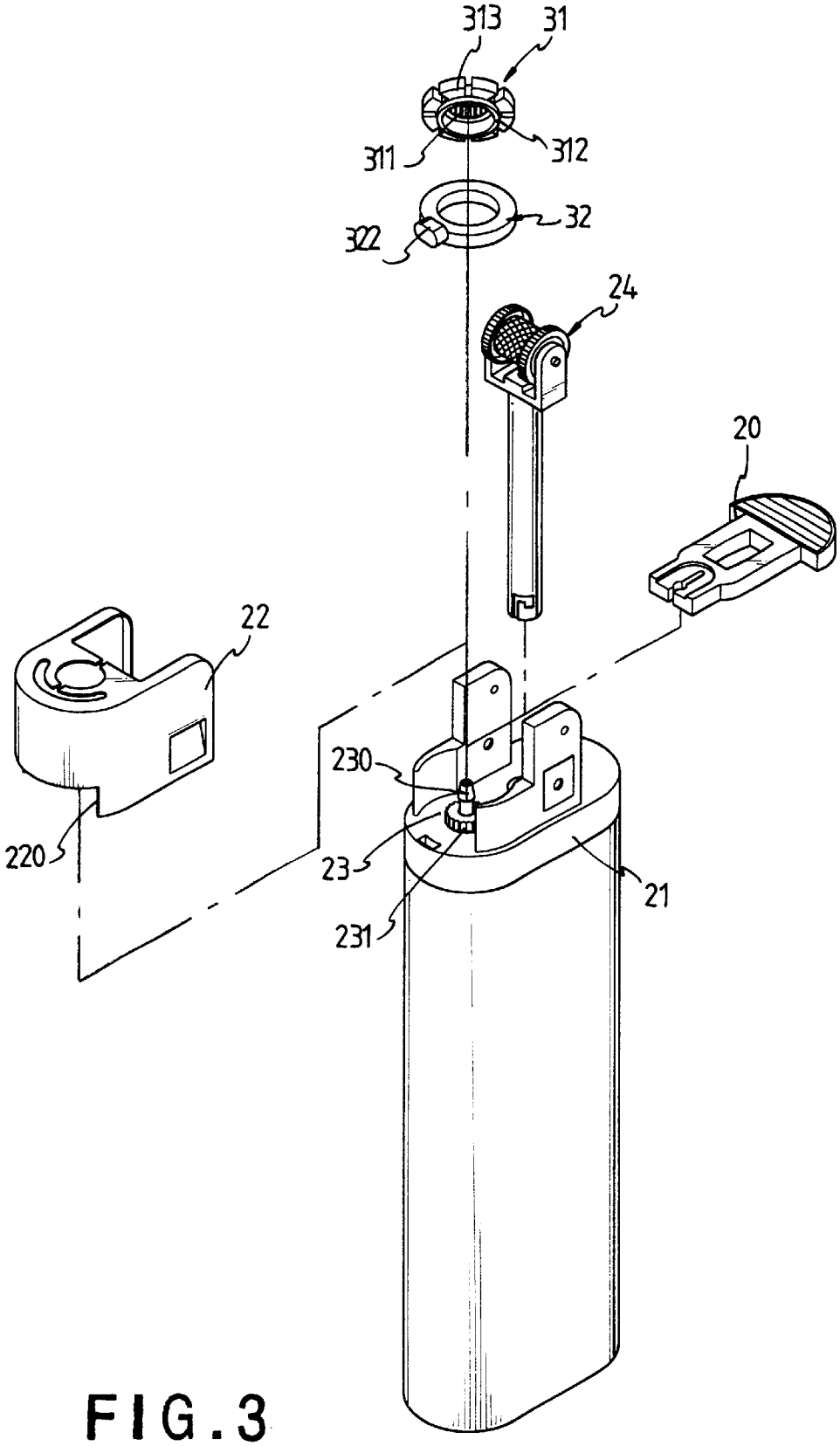
FIG. 3 is an exploded view to show a flame adjusting device of the present invention for a lighter.
Figure 4:
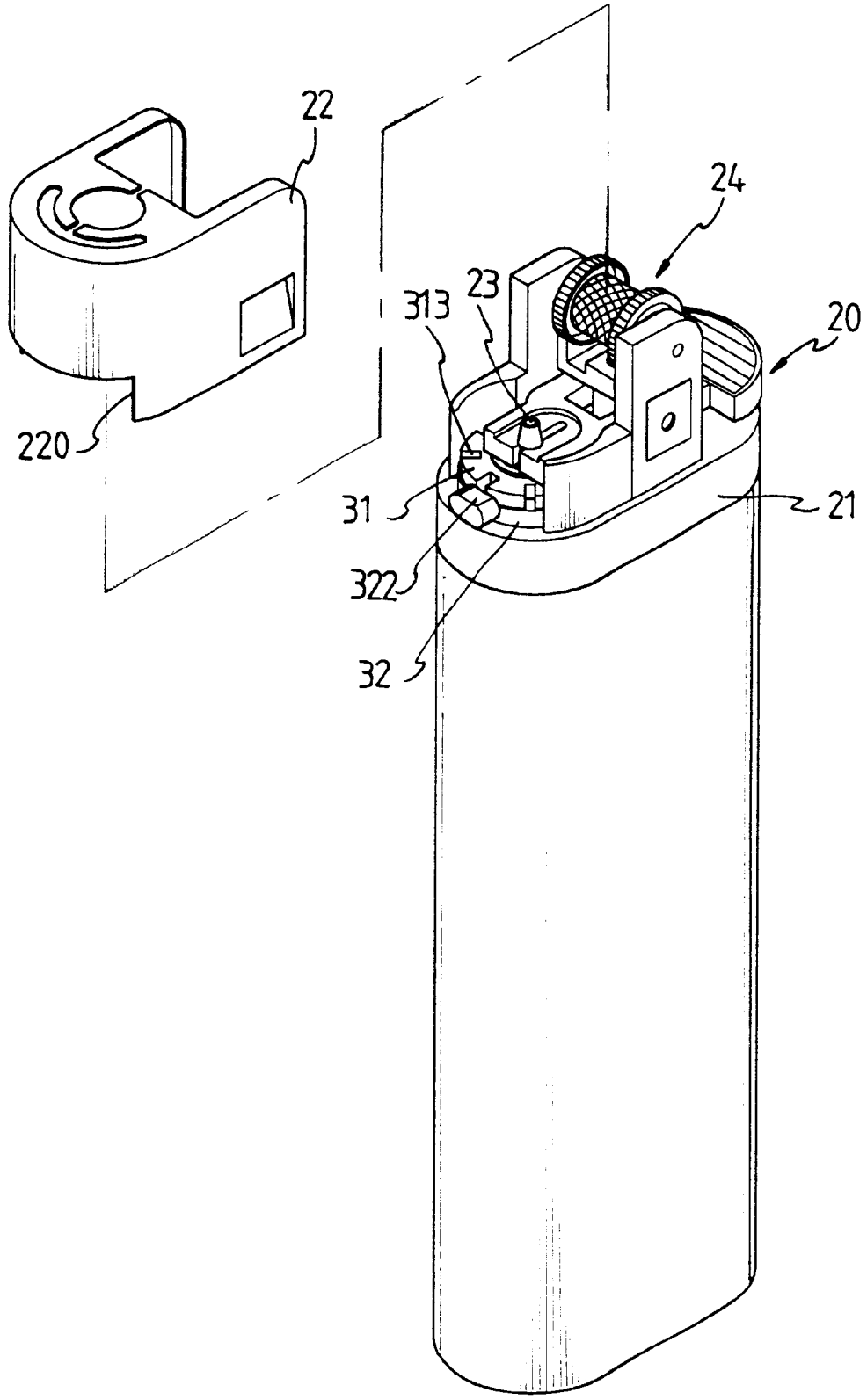
FIG. 4 shows the assembly of the flame adjusting device of the present invention.
Figure 5:
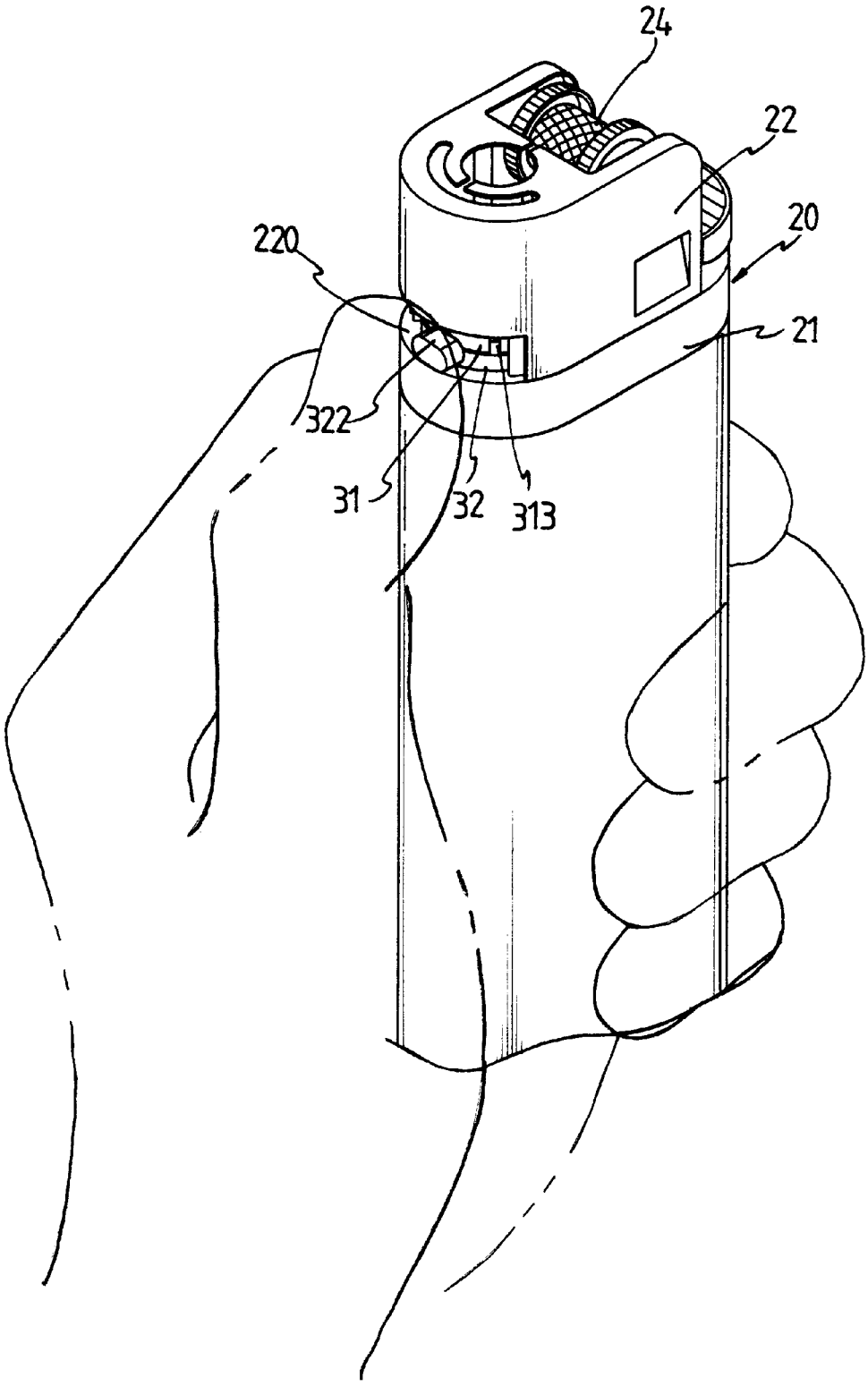
FIG. 5 is a perspective view to show a user shafting a protrusion of a ring of the flame adjusting device of the present invention.

Referring to FIGS. 3 and 4, a lighter includes a gas tank and a top cap 21 is mounted to the tank and closes the tank. A valve is received below the top cap 21 and includes a disk 23 which controls a volume of gas released via the valve. A tube 230 extends from the disk 23 and a gas lever 20 is connected to the tube 230. A striker member 24 is located beside the tube 230. The flame adjusting device 30 of the present invention comprises a flame adjusting wheel 31 having a hole 311 defined centrally therethrough and a neck 312 extends from a side of the flame adjusting wheel 31 and encloses a periphery of the hole 311. The hole 311 has a threaded inner periphery and the disk 23 has a threaded outer periphery 231 so that the flame adjusting wheel 31 is co-rotatably mounted to the disk 23. A ring 32 is mounted to the neck 312 and a protrusion 322 extends radially outward from the ring 32. The protrusion 322 is accessed from a notch 220 of a U-shaped member 22 mounted to the top of the tank. As shown in FIG. 5, a user holds the tank and shifts the protrusions 322 by his/her thumb to adjust the flame. It is to be noted that a plurality of projections 313 extend radially outward from the flame adjusting wheel 31 and the length of the projections 313 is shorter than the protrusion 322 so that when shifting the protrusion 322, the user's thumb will not touch the flame adjusting wheel 31. The friction between the neck 312 and the ring 32 is large enough to let the flame adjusting wheel 31 co-rotate with the ring 32.

Figure 6:
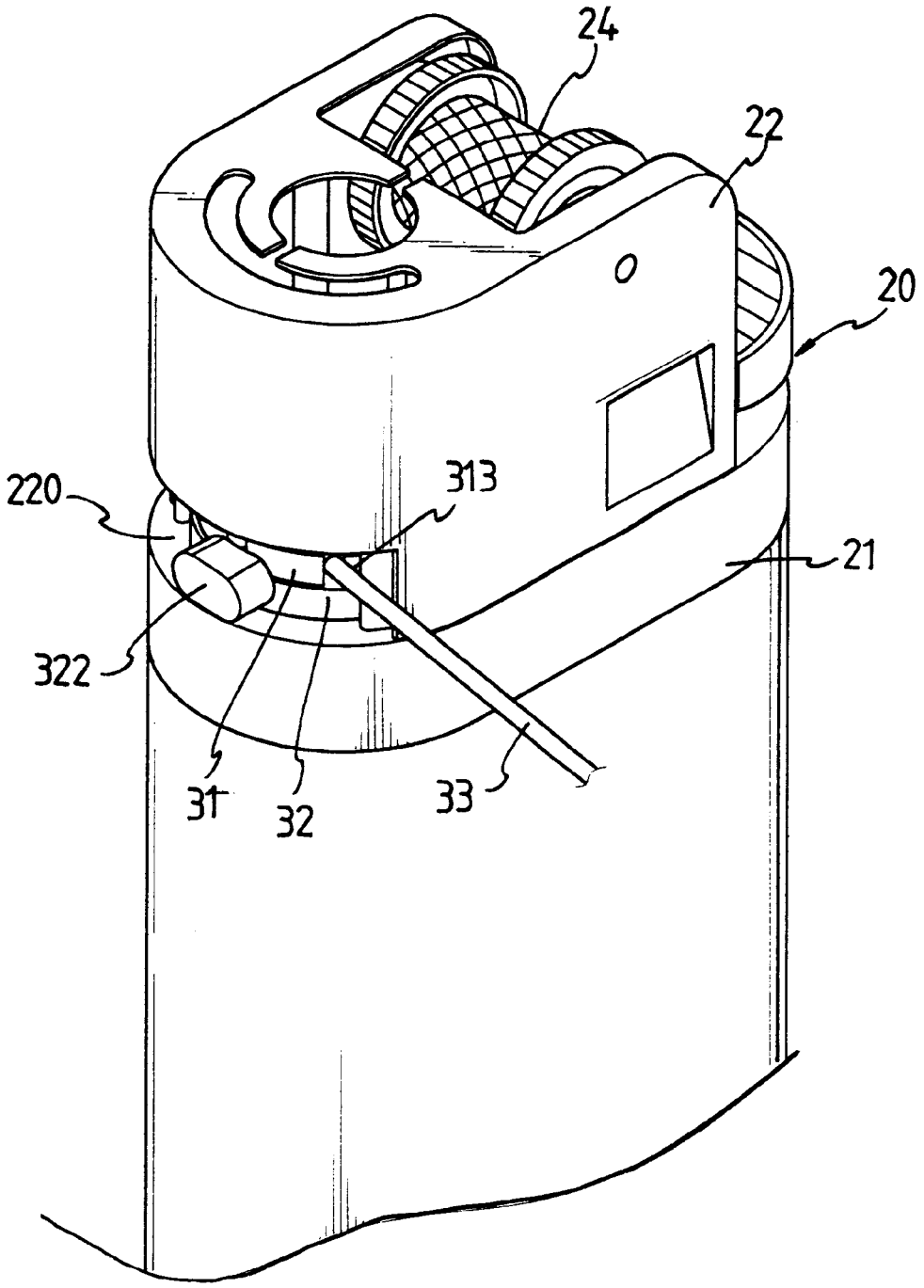
FIG. 6 is a perspective view to show a user using a stick to rotate a flame adjusting wheel of the flame adjusting device of the present invention.

As shown in FIG. 6, if the user wants to change the volume of gas released via the valve, he/she holds or presses the protrusion 322 or the ring 32 and then uses a stick 33 to rotate the flame adjusting wheel 31 by inserting a top of the stick 33 in one of the gaps defined between the projections 313. The force applied to the flame adjusting wheel 31 by the stick 33 is larger than the friction between the neck 312 and the ring 32 so that the disk 23 is rotated with the flame adjusting wheel 31 while the ring 32 is remained still.

Figure 7:
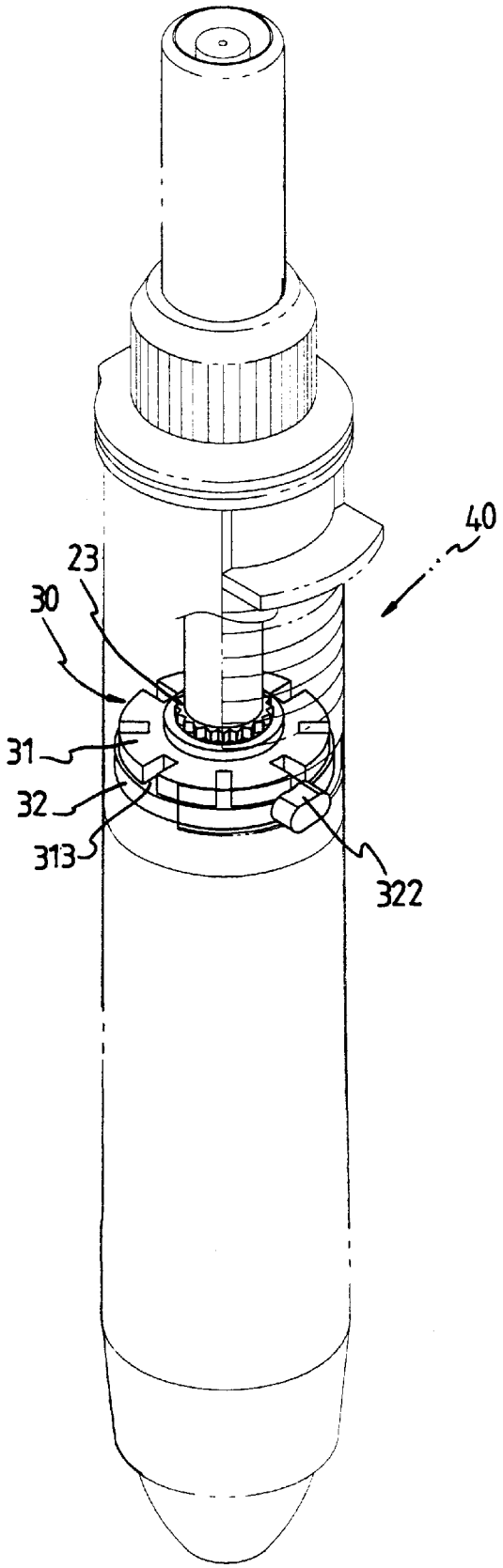
FIG. 7 shows the flame adjusting device of the present invention used in another type of gas burning device.

The flame adjusting device of the present invention can also be used in other type of gas burning device 40 such as shown in FIG. 7.

While we have shown and described various embodiments in accordance with the present invention, it should be clear to those skilled in the art that further embodiments may be made without departing from the scope and spirit of the present invention.

What is claimed is:

1. A gas burning device comprising:

a gas tank and a valve connected to said gas tank, said valve having a tube and a disk mounted to said tube so as to control a volume of gas released via said valve, a gas lever connected to said tube and a striker member located beside said disk, and a flame adjusting device connected to said valve and comprising a flame adjusting wheel which has a hole defined centrally therethrough, said disk securely engaged with said hole of said flame adjusting wheel, a neck extending from a periphery of said hole and a ring mounted to said neck so as to be frictionally rotated with said flame adjusting ring.

2. The flame adjusting device as claimed in claim 1, wherein said hole has a threaded inner periphery.

3. The flame adjusting device as claimed in claim 1 further comprising a plurality of projections extending radially outward from said flame adjusting wheel.

4. The flame adjusting device as claimed in claim 1 further comprising a protrusion extending radially outward from said ring.

* * * * *